United States Patent [19]

Azami et al.

[11] Patent Number: 4,722,671

[45] Date of Patent: Feb. 2, 1988

[54] CYLINDER BLOCK FOR A REFRIGERATION COMPRESSOR

[75] Inventors: Katsumasa Azami, Isesaki; Shigemi Shimizu, Sakai, both of Japan

[73] Assignee: Sanden Corporation, Isesaki, Japan

[21] Appl. No.: 833,124

[22] Filed: Feb. 26, 1986

[30] Foreign Application Priority Data

Feb. 26, 1985 [JP] Japan ..... 60-25398[U]

[51] Int. Cl.[4] ..... F04B 1/12

[52] U.S. Cl. ..... 417/269; 417/571

[58] Field of Search ..... 417/269, 270, 271, 571, 417/564, 569

[56] References Cited

U.S. PATENT DOCUMENTS

| | | | |
|---|---|---|---|
| 592,235 | 10/1967 | Campbell | 417/569 |
| 3,215,341 | 11/1965 | Francis | 417/269 |
| 4,283,166 | 8/1981 | Hiraga | 417/269 |

FOREIGN PATENT DOCUMENTS

| | | | |
|---|---|---|---|
| 254586 | 8/1927 | Italy | 417/269 |
| 180080 | 10/1984 | Japan | 417/269 |

*Primary Examiner*—Leonard E. Smith

*Attorney, Agent, or Firm*—Banner, Birch, McKie & Beckett

[57] ABSTRACT

A piston-type refrigeration compressor having a more secure valve plate seal is disclosed. A cylinder housing is provided with a cylinder block having a plurality of cylinders at one end. The end surface of the cylinder block near the cylinder is coupled to a cylinder head through gaskets and a valve plate. A circular depression is formed on the end surface of the cylinder block to accommodate the gasket substantially within the depression and thereby seal the cylinder block and valve plate. In this way, the outward expansion of the gasket is prevented which prevents the gasket from deteriorating.

3 Claims, 4 Drawing Figures

CYLINDER BLOCK FOR A REFRIGERATION COMPRESSOR

TECHNICAL FIELD

The present invention relates to a reciprocating piston-type refrigeration compressor, and more particularly, to a compressor in which gaskets are placed on both sides of a valve plate between the cylinder block and the cylinder head to provide a secure seal.

BACKGROUND OF THE INVENTION

Referring to FIGS. 1 and 2, a conventional construction for placement of gaskets adjacent the valve plate in a piston-type compressor is shown. Valve plate 1 is coupled to one end surface of cylinder block 2 through gaskets 3. The other end surface of valve plate 1 is coupled to cylinder head 4 through gasket 5. Through the reciprocating movement of the pistons, the refrigerant is taken into cylinder 6 from suction chamber 7 through suction hole 71 formed in valve plate 1. Compressed refrigerant gas in cylinder 6 is discharged to discharge chamber 8 through discharge hole 81 formed in valve plate 1.

In the above construction, cylinder block 2, gaskets 3 and 5, valve plate 1 and cylinder head 4 are aligned parallel to one another on the compressor. A disadvantage of this construction is that, because high pressure caused by liquid compression within the compressor acts in a direction normal to gasket 3 disposed between the cylinder block and the valve plate, a high pressure force is exerted directly on the gasket. Over time, this high pressure force expands the gasket outwardly until the gasket finally breaks down.

SUMMARY OF THE INVENTION

It is a primary object of the present invention to provide a refrigeration compressor in which expansion of the gaskets adjacent the valve plate is prevented to thereby prevent deterioration of the gaskets.

It is another object of the present invention to provide an improved refrigeration compressor wherein durability is improved with only a small modification in the construction of present compressors.

A refrigeration compressor in accordance with the present invention includes a front housing, a cylinder block having a plurality of cylinders, pistons which are reciprocatably disposed in the cylinders, a valve plate which has a suction port and a discharge port for communicating with the cylinders and a cylinder head. The valve plate is coupled between the outer end surface of the cylinder block and the one end surface of the cylinder head. Gaskets are placed on either side of the valve plate. A circular shaped depression or indentation is formed on one end surface of the cylinder block between the cylinder block and the valve plate for accommodating the gasket. In this way, expansion of the gasket is prevented, thus increasing the usable life of the gasket.

Further objects, features and other aspects of this invention will be understood from the following detailed descripton of a preferred embodiment of the invention and by referring to the annexed drawings.

IDETAILED DESCRIPTION OF THE PREFERRED EMBODIMENT

Figure 1:
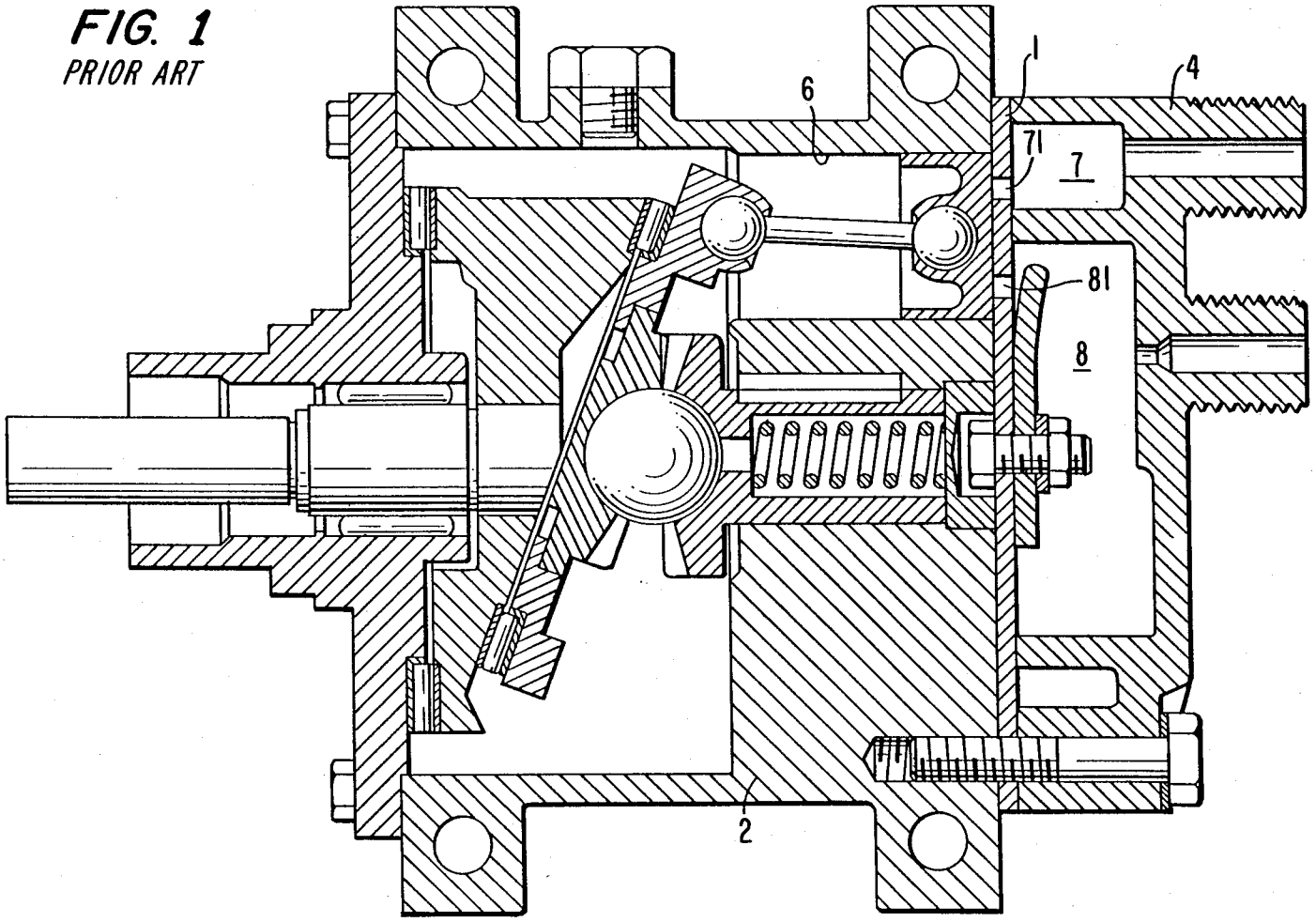
FIG. 1 PRIOR ART
FIG. 1 is a cross-sectional view of a PRIOR ART refrigeration compressor.
Figure 2:
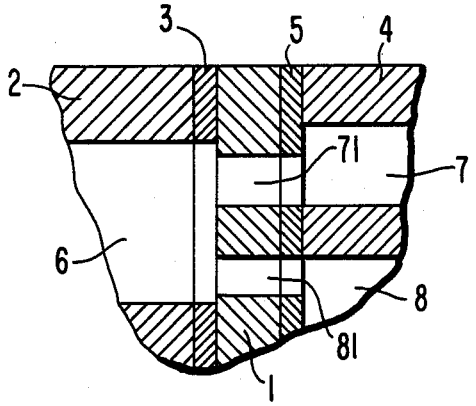
FIG. 2 PRIOR ART
FIG. 2 is an enlarged cross-sectional view of a portion of the PRIOR ART refrigeration compressor shown in FIG. 1.
Figure 4:
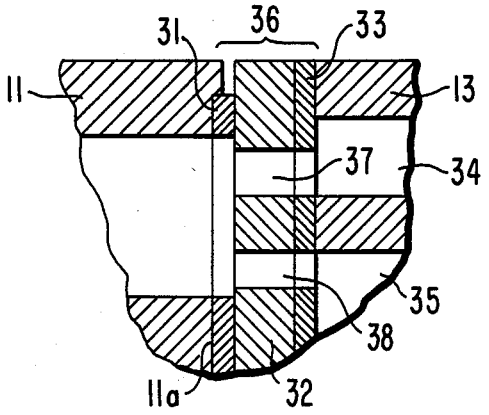
FIG. 4 is an enlarged cross-sectional view of a portion of the refrigeration compressor shown in FIG. 3 in accordance with the present invention.
Figure 3:
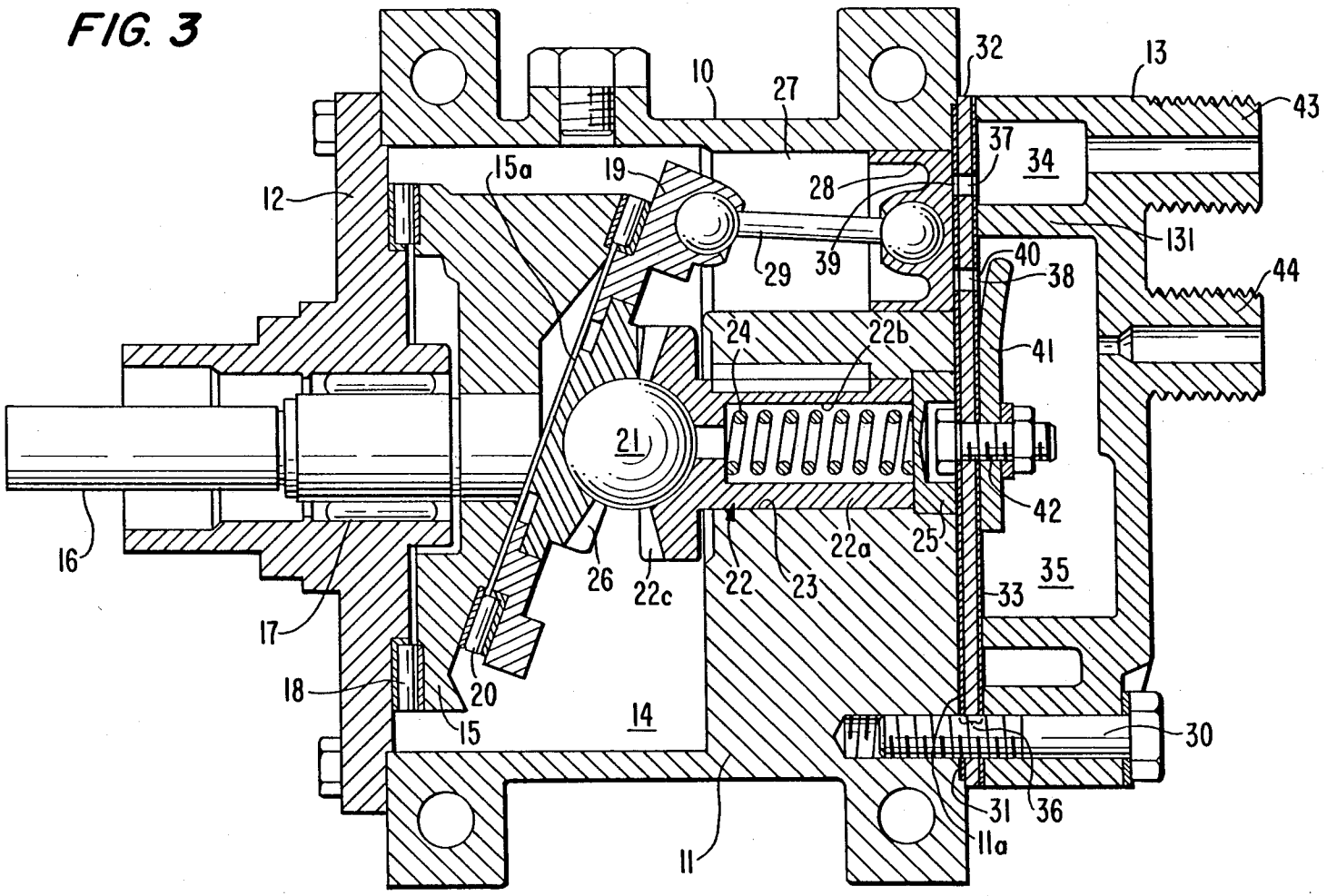
FIG. 3 is a cross-sectional view of a refrigeration compressor in accordance with the present invention.

Referring to FIGS. 3 and 4, a refrigeration compressor in accordance with the present invention includes cylinder housing 10 including cylinder block 11, front housing 12 and cylinder head 13. The interior of housing 10 defines crank chamber 14 between cylinder block 11 and housing 12. Rotor 15 also is supported on the inner surface of front housing 12 by means of a bearing, such as thrust needle bearing 17, in front housing 12. Rotor 15 also is supported on the inner surface of front housing 12 by means of thrust needle bearing 18. Wobble plate 19 is disposed on inclined surface **15*a* of rotor 15 through thrust needle bearing 20. Wobble plate 19 is nonrotatably supported on steel ball 21 seated at an end of supporting member 22**.

Supporting member 22 includes shank portion **22*a* having axial hole 22*b* at its other end and bevel gear portion 22*c* at the end of shank portion 22*a*, the bevel gear portion having a seat for steel ball 21 at the center thereof. Supporting member 22 is axially slidable but non-rotatably supported within cylinder block 11 by the insertion of shank portion 22*a* into axial hole 23 formed in cylinder block 11. The rotation of supporting member 22 is prevented by means of a key and key groove (not shown). Coil spring 24 is disposed in axial hole 22*b* of supporting member 22 and the outer end of spring 24 is in contact with screw member 25 so that shank portion 22*a* is urged toward wobble plate 19. Bevel gear portion 22*c* of supporting member 22 engages with bevel gear 26 mounted on wobble plate 19 so that the rotation of wobble plate is prevented. Steel ball 21 is seated in the seat formed at the central portion of bevel gear 26 so that wobble plate 19 may be nutatably but non-rotatably supported on steel ball 21**.

Cylinder block 11 is provided with a plurality of axial cylinders 27 formed therein, within which pistons 28 are slidably and closely fitted. Each piston 28 is connected to wobble plate 10 through piston rod 29. The ends of piston rods 29 are connected to wobble plate 19 by a plurality of ball joint mechanisms. Similarly, pistons 28 and the other ends of piston rods 29 are also connected by a plurality of ball joint mechanisms.

Cylinder head 13 is disposed on the outer end of cylinder block 11 and is secured thereto by means of bolts 30. Circular-shaped depression or indentation **11*a* is formed on the outer end surface of cylinder block 11. The depth of depression 11*a* is equal to or slightly smaller than the axial thickness of gasket 31 for accommodating gasket 31 therein. Gasket 31 is disposed in depression 11*a* and securely held therein by the fastening of valve plate 32 to the outer end of cylinder block 11**.

Cylinder head 13 is provided with suction chamber 34 and discharge chamber 35 separated by partition wall 131. Valve plate assembly 36 includes valve plate 32 having suction ports 37 connecting suction chamber 34 and cylinders 27 and discharge ports 38 connecting discharge chamber 35 and cylinders 27. Valve plate assembly 36 further includes suction reed valve 39, and discharge reed valve 40. A stopper plate 41 suppresses excessive deformation of discharge reed valve 40. Bolt and nut device 42 secures suction reed valve 39, discharge reed valve 40 and stopper plate 41 to valve plate 32. Cylinder head 13 is secured on the end surface of cylinder block 11 through valve plate assembly 36 and gasket 33 by means of bolts 30. Thus, the interior of the compressor is sealed.

In operation of the compressor, drive shaft 16 is driven by any suitable driving source, such as an automobile engine. Rotor 15 rotates with drive shaft 16, so that wobble plate 19 may nutate about steel ball 21 according to the rotation of inclined surface 15*a* of rotor 15. The nutation of wobble plate 19 causes the reciprocation of each respective piston 28. Therefore, the evacuation and compression of the refrigerant gas is repeatedly performed in each cylinder. The refrigerant gas circulates through a cooling circuit which is connected between inlet port 43 and outlet port 44, which are provided on cylinder head 13 and are connected with suction chamber 34 and discharge chamber 35, respectively. Gasket 31 in circular shaped depression or indentation 11*a* in the end surface of cylinder block 11 facing valve plate 32 seals valve plate 32 and cylinder block 11 to prevent leakage of the refrigerant gas during the compression cycle. The use of depression or indentation 11*a* prevents premature wear of gasket 31 thereby extending its useful life and improving sealing effectiveness.

This invention has been described in detail in connection with a preferred embodiment, but is merely for illustrative purposes only and the invention is not limited thereto. It will be easily understood by those skilled in the art that variations and modifications can be easily made within the scope of this invention as defined by the appended claims.

We claim:

1. In a refrigeration compressor including a compressor housing, a cylinder block mounted within said compressor housing and having a plurality of equiangularly spaced cylinders, a plurality of pistons slidably and closely fitted into said cylinders, a front end plate, a cylinder head fixedly disposed on one end surface of said cylinder block through a valve plate, a first gasket disposed between the nd surface of said cylinder block and said valve plate and a second gasket disposed between said valve plate and said cylinder head to secure the sealing therebetween, the improvement comprising a circular shaped depression formed on one end surface of said cylinder block to accommodate said first gasket to prevent expansion of said first gasket due to high pressure during compression, said first gasket filling the entire volume of said circular shaped depression, said valve plate and said cylinder head being disposed outside said circular shaped depression.

2. The refrigerant compressor of claim 1 wherein the depth of said depression is approximately equal to the thickness of said first gasket.

3. The refrigerant compressor of claim 1 wherein the depth of said depression is slightly smaller than the thickness of said first gasket.

* * * * *

UNITED STATES PATENT AND TRADEMARK OFFICE

CERTIFICATE OF CORRECTION

PATENT NO. : 4,722,671

DATED : February 2, 1988

INVENTOR(S) : Katsumasa Azami

It is certified that error appears in the above-identified patent and that said Letters Patent is hereby corrected as shown below:

In claim 1, line 16, change "nd" to --end--.

Signed and Sealed this

Twenty-third Day of August, 1988

*Attest:*

DONALD J. QUIGG

*Attesting Officer*

*Commissioner of Patents and Trademarks*